US007980331B2

(12) United States Patent
Hall et al.

(10) Patent No.: US 7,980,331 B2
(45) Date of Patent: Jul. 19, 2011

(54) ACCESSIBLE DOWNHOLE POWER ASSEMBLY

(75) Inventors: David R. Hall, Provo, UT (US); Paula Turner, Pleasant Grove, UT (US); Nathan Nelson, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 0 days.

(21) Appl. No.: 12/358,446

(22) Filed: Jan. 23, 2009

(65) Prior Publication Data

US 2010/0186944 A1 Jul. 29, 2010

(51) Int. Cl.
*E21B 17/16* (2006.01)

(52) U.S. Cl. ..... 175/320; 175/104; 166/65.1; 166/66

(58) Field of Classification Search ..... 175/320, 175/104; 166/65.1, 378, 380, 66, 250.01; 429/96–100, 164
See application file for complete search history.

(56) References Cited

U.S. PATENT DOCUMENTS 3,133,776 A * 5/1964 Magers et al. ..... 439/248
3,967,201 A 6/1976 Rorden
4,416,494 A 11/1983 Watkins
4,515,225 A * 5/1985 Dailey ..... 175/40
4,628,995 A * 12/1986 Young et al. ..... 166/113
4,806,928 A 2/1989 Veneruso
4,884,071 A 11/1989 Howard
5,144,126 A * 9/1992 Perry et al. ..... 250/254
5,176,528 A * 1/1993 Fry et al. ..... 439/181
5,251,708 A * 10/1993 Perry et al. ..... 175/41
6,209,632 B1 * 4/2001 Holbert et al. ..... 166/65.1
6,224,997 B1 * 5/2001 Papadopoulos ..... 429/99
6,280,874 B1 * 8/2001 Hensley et al. ..... 429/98
6,349,772 B2 * 2/2002 Mullen et al. ..... 166/387
6,392,317 B1 5/2002 Hall
6,394,837 B1 * 5/2002 Edwards et al. ..... 439/426
6,405,795 B2 * 6/2002 Holbert et al. ..... 166/66
6,442,105 B1 * 8/2002 Tubel et al. ..... 367/82
6,547,010 B2 * 4/2003 Hensley et al. ..... 166/378
6,610,441 B2 * 8/2003 Hensley et al. ..... 429/163
6,655,452 B2 * 12/2003 Zillinger ..... 166/66
6,670,880 B1 12/2003 Hall
6,672,383 B2 * 1/2004 Holbert et al. ..... 166/66
6,705,406 B2 * 3/2004 Das et al. ..... 166/381
6,717,501 B2 4/2004 Hall
6,799,632 B2 10/2004 Hall
6,821,147 B1 11/2004 Hall
6,830,467 B2 12/2004 Hall
6,844,498 B2 1/2005 Hall
6,899,178 B2 5/2005 Tubel
6,913,093 B2 7/2005 Hall
6,929,493 B2 8/2005 Hall
6,945,802 B2 9/2005 Hall
6,968,611 B2 11/2005 Hall
7,036,609 B2 * 5/2006 Michael et al. ..... 175/19
7,074,064 B2 * 7/2006 Wallace ..... 439/190
7,093,680 B2 * 8/2006 Holbert et al. ..... 175/320
7,105,249 B2 * 9/2006 Hall et al. ..... 429/176

(Continued)

*Primary Examiner* — Jennifer H Gay
(74) *Attorney, Agent, or Firm* — Holme Roberts & Owen LLC

(57) ABSTRACT

A drill string component includes a downhole power assembly and a center mandrel with a through-bore adapted to accommodate a flow of drilling fluid. The downhole power assembly includes a tubular battery cage disposed around the center mandrel. At least one battery is disposed in at least one bay formed in the tubular battery cage and a tubular sleeve is adapted to slide over and cover the tubular battery cage.

16 Claims, 10 Drawing Sheets

U.S. PATENT DOCUMENTS 7,121,363 B2 * 10/2006 Michael et al. ..... 175/45
7,147,965 B2 * 12/2006 Hall et al. ..... 429/176
7,172,035 B2 * 2/2007 Michael et al. ..... 175/19
7,224,288 B2 * 5/2007 Hall et al. ..... 340/853.7
7,253,745 B2 * 8/2007 Hall et al. ..... 340/854.4
7,816,929 B2 * 10/2010 Yamada ..... 324/754.07
2001/0049049 A1 * 12/2001 Hensley et al. ..... 429/50
2002/0012837 A1 * 1/2002 Hensley et al. ..... 429/174
2002/0060095 A1 * 5/2002 Wentworth et al. ..... 175/73
2002/0159228 A1 * 10/2002 Emberty et al. ..... 361/683
2002/0189803 A1 * 12/2002 Holbert et al. ..... 166/66
2003/0183384 A1 10/2003 Das
2004/0145492 A1 7/2004 Hall
2004/0150532 A1 8/2004 Hall
2004/0164833 A1 8/2004 Hall
2004/0164838 A1 8/2004 Hall
2004/0216847 A1 11/2004 Hall
2004/0244916 A1 12/2004 Hall
2004/0244964 A1 12/2004 Hall
2004/0246142 A1 12/2004 Hall
2004/0248000 A1 * 12/2004 Hall et al. ..... 429/176
2004/0248001 A1 * 12/2004 Hall et al. ..... 429/176
2005/0001735 A1 * 1/2005 Hall et al. ..... 340/853.7
2005/0001736 A1 1/2005 Hall
2005/0001738 A1 1/2005 Hall
2005/0035874 A1 2/2005 Hall
2005/0035875 A1 2/2005 Hall
2005/0035876 A1 2/2005 Hall
2005/0036507 A1 2/2005 Hall
2005/0039912 A1 2/2005 Hall
2005/0045339 A1 3/2005 Hall
2005/0046586 A1 3/2005 Hall
2005/0046590 A1 3/2005 Hall
2005/0067159 A1 3/2005 Hall
2005/0070144 A1 3/2005 Hall
2005/0082092 A1 4/2005 Hall
2005/0092499 A1 5/2005 Hall
2005/0093296 A1 5/2005 Hall
2005/0095827 A1 5/2005 Hall
2005/0115717 A1 6/2005 Hall
2005/0145406 A1 7/2005 Hall
2005/0150653 A1 * 7/2005 Hall et al. ..... 166/178
2005/0161215 A1 7/2005 Hall
2005/0173128 A1 8/2005 Hall
2005/0212530 A1 9/2005 Hall
2005/0236160 A1 10/2005 Hall
2006/0100968 A1 * 5/2006 Hall et al. ..... 705/400
2006/0151213 A1 * 7/2006 Michael et al. ..... 175/40
2006/0221768 A1 * 10/2006 Hall et al. ..... 367/82
2007/0001692 A1 * 1/2007 Yamada ..... 324/754
2007/0039756 A1 * 2/2007 Wright et al. ..... 175/40
2007/0194948 A1 * 8/2007 Hall et al. ..... 340/854.8
2008/0012569 A1 * 1/2008 Hall et al. ..... 324/367
2008/0047753 A1 * 2/2008 Hall et al. ..... 175/57
2008/0083529 A1 * 4/2008 Hall et al. ..... 166/66
2009/0188663 A1 * 7/2009 Hall et al. ..... 166/66
2010/0186944 A1 * 7/2010 Hall et al. ..... 166/65.1
2010/0200244 A1 * 8/2010 Purkis ..... 166/373

* cited by examiner

ACCESSIBLE DOWNHOLE POWER ASSEMBLY

FIELD

The present invention relates to tools for use in downhole drilling, and more particularly, to systems and methods for installing and accessing batteries in a tool for use in a downhole tool string.

BACKGROUND OF THE INVENTION

U.S. Pat. No. 6,899,178 Tubel, which is herein incorporated by reference for all that it contains, discloses tools for deployment downhole in a wellbore for aiding in the production of hydrocarbons. In an exemplary embodiment, the tools comprise a tool body; an electrically powered device disposed proximate the tool body; a removable power source for providing power to the device disposed in the tool body, the power source connected to or mounted into or about the tool body, the power source further being fixed or replaceable downhole; and a wireless communications device operatively connected to the electrically powered device.

U.S. Pat. No. 4,884,071 to Howard, which is herein incorporated by reference for all that it contains, discloses an improved wellbore tool for coupling to a drill string at a threaded junction and adapted for use in a wellbore during drilling. A sensor is disposed in the wellbore tool for sensing a condition and producing a data signal corresponding to the condition. A self-contained power supply is disposed in the wellbore tool and coupled to the sensor for providing power to the sensor as required. The Hall Effect coupling transmitter means is carried by the sensor and for transmitting data from the Hall Effect coupling receiver carried by the drill string and disposed across the threaded junction from the wellbore tool, wherein data is transmitted across the threaded junction without requiring an electrical connection at the threaded junction.

U.S. Pat. No. 6,442,105 to Tubel, which is herein incorporated by reference for all it contains, discloses an acoustic transmission system wherein acoustic communication is transmitted over an acoustic medium comprising production tubing, well casing or over continuous tubing in a well (e.g., coil tubing, chemical injection tubing or dewatering string). More specifically, the acoustic medium has an acoustic tool associated therewith, which is permanently located downhole with the sensors and electromechanical devices typically employed in a well, and an acoustic tool associated therewith uphole. The downhole sensors are connected to the downhole acoustic tool for acoustic communication. The acoustic tool includes a piezoelectric ceramic transducer (i.e., a stack of piezoelectric elements) or an accelerometer for transmitting or receiving acoustic signals transmitting through the medium.

BRIEF SUMMARY OF THE INVENTION

In one aspect of the present invention, a downhole power assembly has a downhole drill string component having a center mandrel with a through-bore adapted to accommodate a flow of drilling fluid. The component has an independent tubular battery cage disposed around the center mandrel. At least one battery is disposed in at least one bay formed in the tubular battery cage and a tubular sleeve is adapted to slide over and cover the tubular battery cage.

A sleeve slide guide is disposed around the center mandrel adjacent to the tubular battery cage and comprises a length at least equal to a length of the tubular battery cage. The sleeve slide guide may have a first end with an outer diameter smaller than an inner diameter of the tubular sleeve and a second end with an outer diameter greater than the inner diameter of the tubular sleeve. The first end of the sleeve slide guide may be adapted to abut against an end of the tubular battery cage. The tubular sleeve may be adapted to slide off of the tubular battery cage onto the sleeve slide guide. The tubular sleeve may have a locking collar adapted to be bolted to the tubular battery cage restricting the movement of the tubular sleeve.

The downhole power assembly may have an electrical contact disposed at a first end of the tubular battery cage adapted to transfer electrical power from the downhole power assembly to an electronics assembly. The electronics assembly may be disposed around the center mandrel of the downhole drill string component. The electronics assembly may be disposed on another downhole drill string component. The electronics assembly may comprise a geophone, a hydrophone, or combinations thereof.

At least one mechanical retainer may be disposed in the at least one bay and is adapted to mechanically retain the at least one battery in the at least one bay. The mechanical retainer may have an extending pin adapted to extend from a body of the mechanical retainer into the at least one bay. The extending pin may be spring actuated, actuated by a biased driving element, piston actuated, or combinations thereof.

The downhole power assembly may have at least one electrical connector adapted to provide an electrical connection between the at least one battery and a power network of a downhole tool component independent of the mechanical retention of the at least one battery in the at least one bay. The at least one electrical connector may have an expandable element disposed in a box adapted to extend a plunger contact through a hole formed in a lid of the box. The expandable element may be a spring, a wave spring, a coil spring, compressible foam, rubber, gas, or combinations thereof. The expandable element may be adapted to extend a second plunger contact through a hole formed in a bottom of the box.

The tubular battery cage may have five bays connected electrically in parallel to a positive junction and a negative junction. An electrical generator may be disposed in another downhole tool string component and may be adapted to send electrical power across at least one annular magnetic coupler to the at least one battery. The downhole power assembly may be adapted to send power across the at least one annular magnetic coupler to another downhole drill string component.

DETAILED DESCRIPTION OF THE INVENTION AND THE PREFERRED EMBODIMENT

Figure 1:
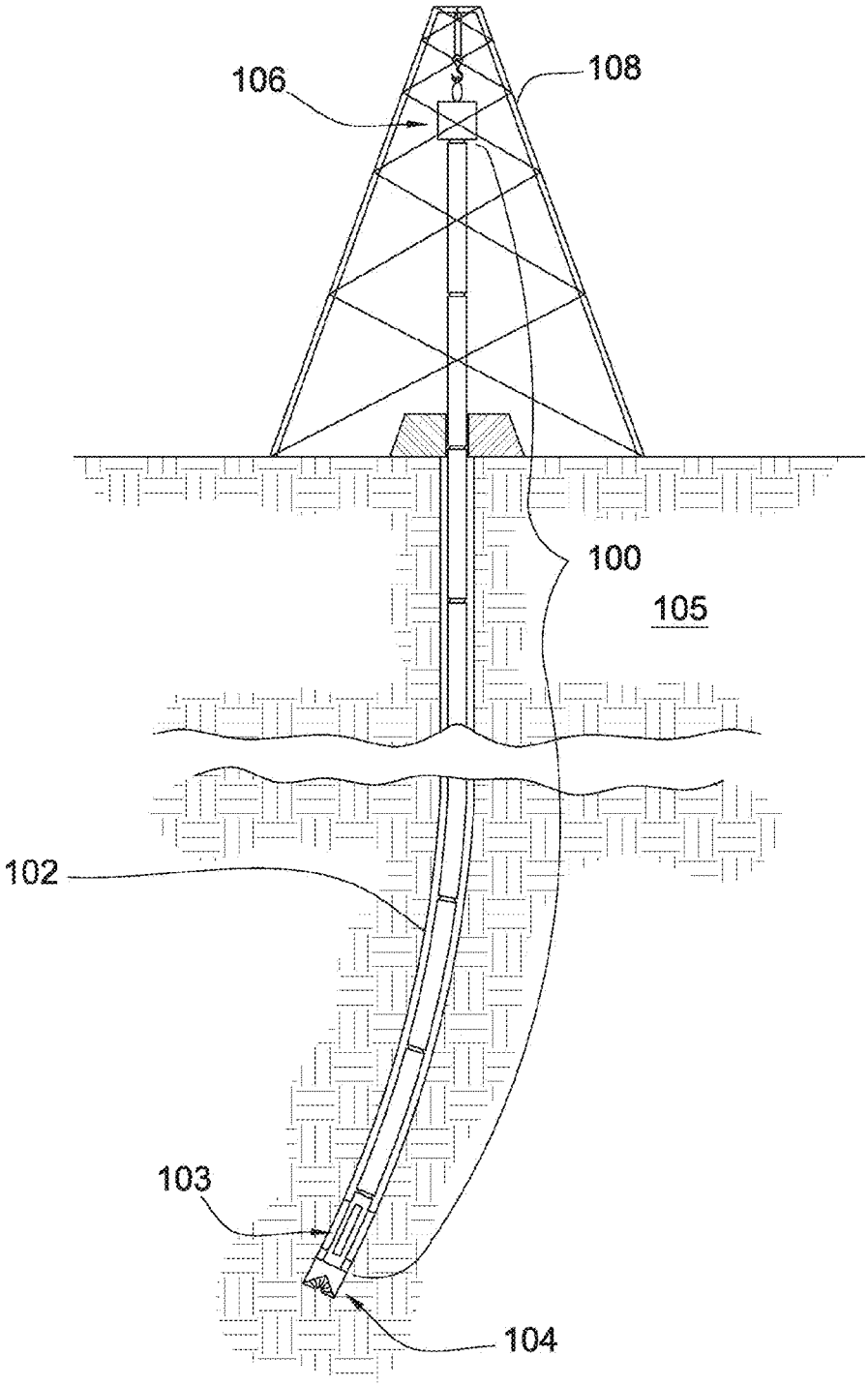
FIG. 1 is a cross-sectional diagram of an embodiment of a drill string suspended in a bore hole.

FIG. 1 is a perspective diagram of an embodiment of a downhole drill string 100 suspended by a derrick 108 in a bore hole 102. A drilling assembly 103 includes a drill bit 104 and is located at the bottom of the bore hole 102. As the drill bit 104 rotates downhole, the downhole drill string 100 advances farther into the earth. The downhole drill string 100 may penetrate soft or hard subterranean formations, such as formation 105. The drilling assembly 103 and/or downhole components may comprise data acquisition devices that may gather data. The data may be sent to the surface via a transmission system to a data swivel 106. The data swivel 106 may send the data to the surface equipment. In addition, the surface equipment may send data and/or power to downhole tools, the drill bit 104 and/or the drilling assembly 103. U.S. Pat. No. 6,670,880, which is herein incorporated by reference for all that it contains, discloses a telemetry system that may be compatible with the present invention. Other forms of telemetry may also be compatible, such as systems that include mud pulse systems, electromagnetic waves, radio waves, wired pipe, and/or short hop.

Figure 2:
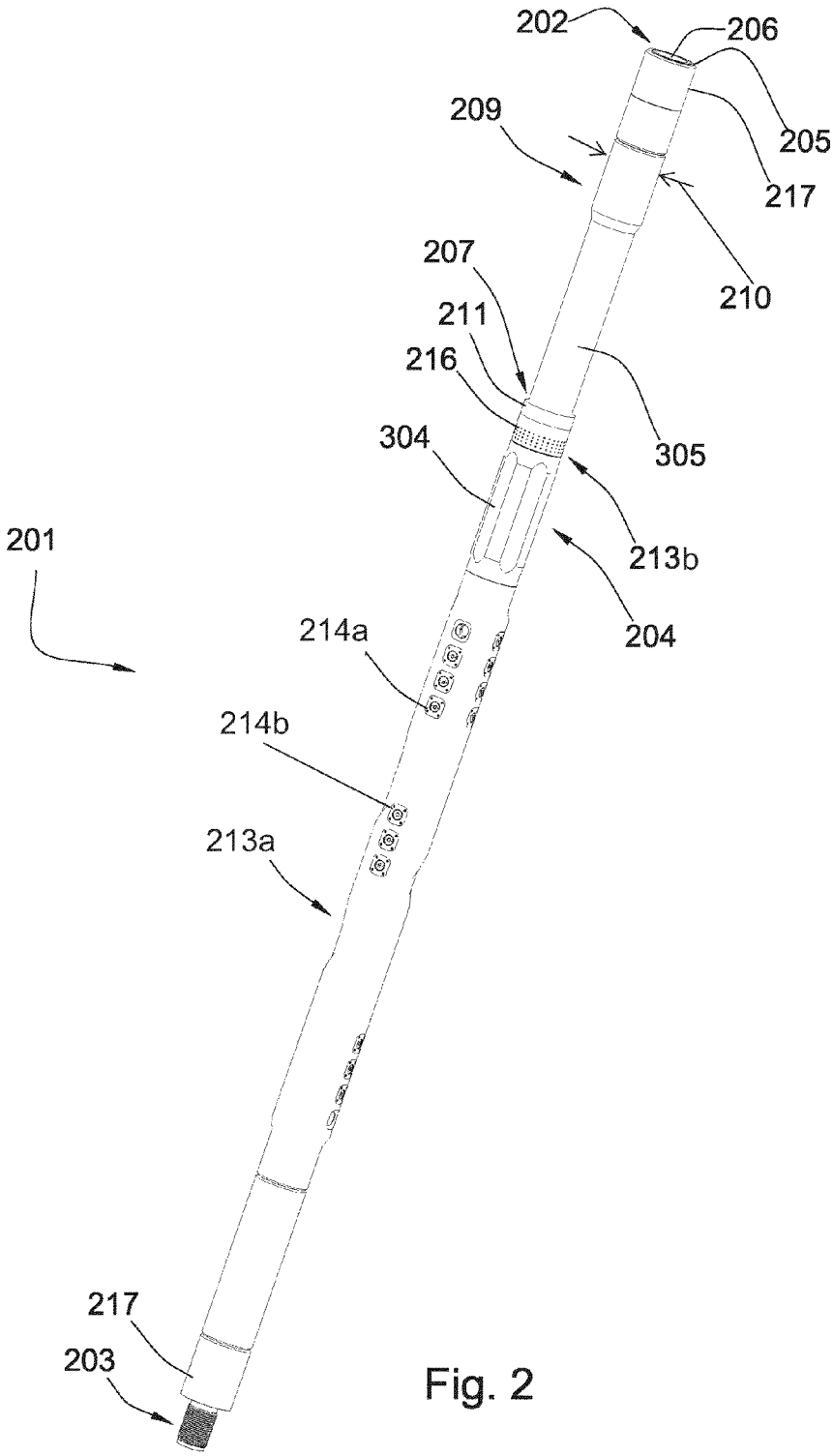
FIG. 2 is a perspective diagram of an embodiment of a downhole drill string component.
Figure 3A:
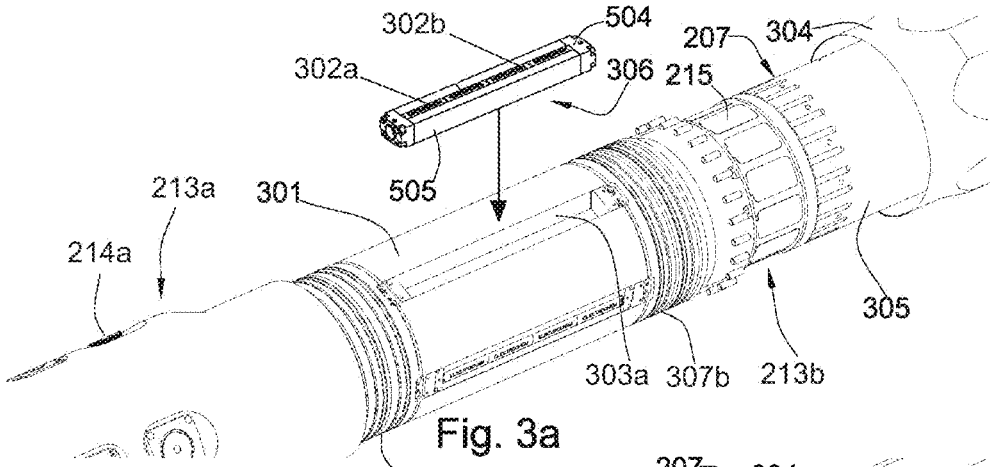
FIG. 3*a* is a perspective diagram of an embodiment of an independent tubular battery cage used within the downhole drill string component illustrated in FIG. 2.
Figure 3B:
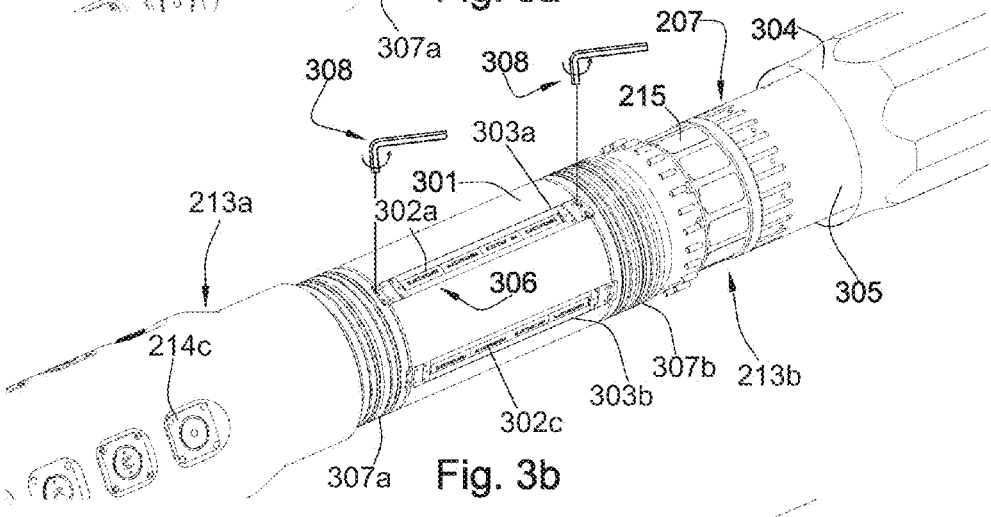
FIG. 3*b* is a perspective diagram of the independent tubular battery cage illustrated in FIG. 3*a* in which an embodiment of a battery pack is being inserted.
Figure 3C:
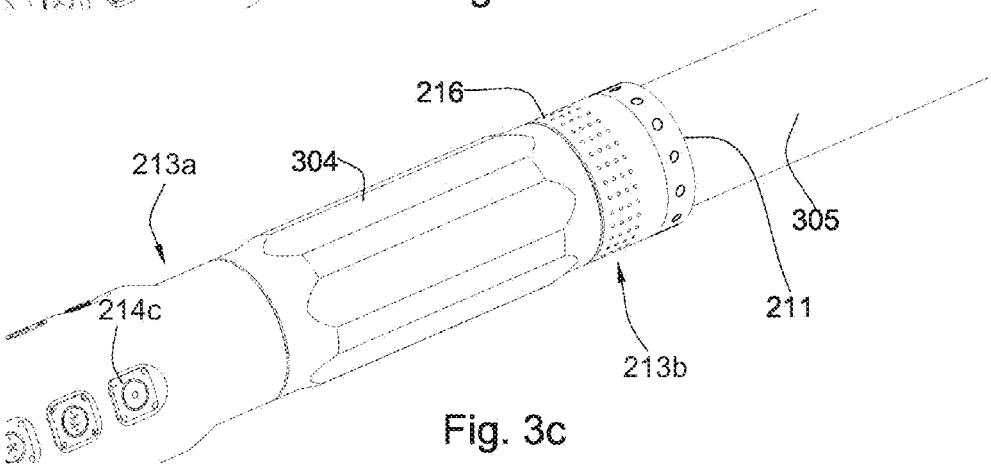
FIG. 3*c* is a perspective diagram of the independent tubular battery cage illustrated in FIG. 3*a* with an embodiment of a tubular sleeve over the tubular battery cage.
Figure 4:
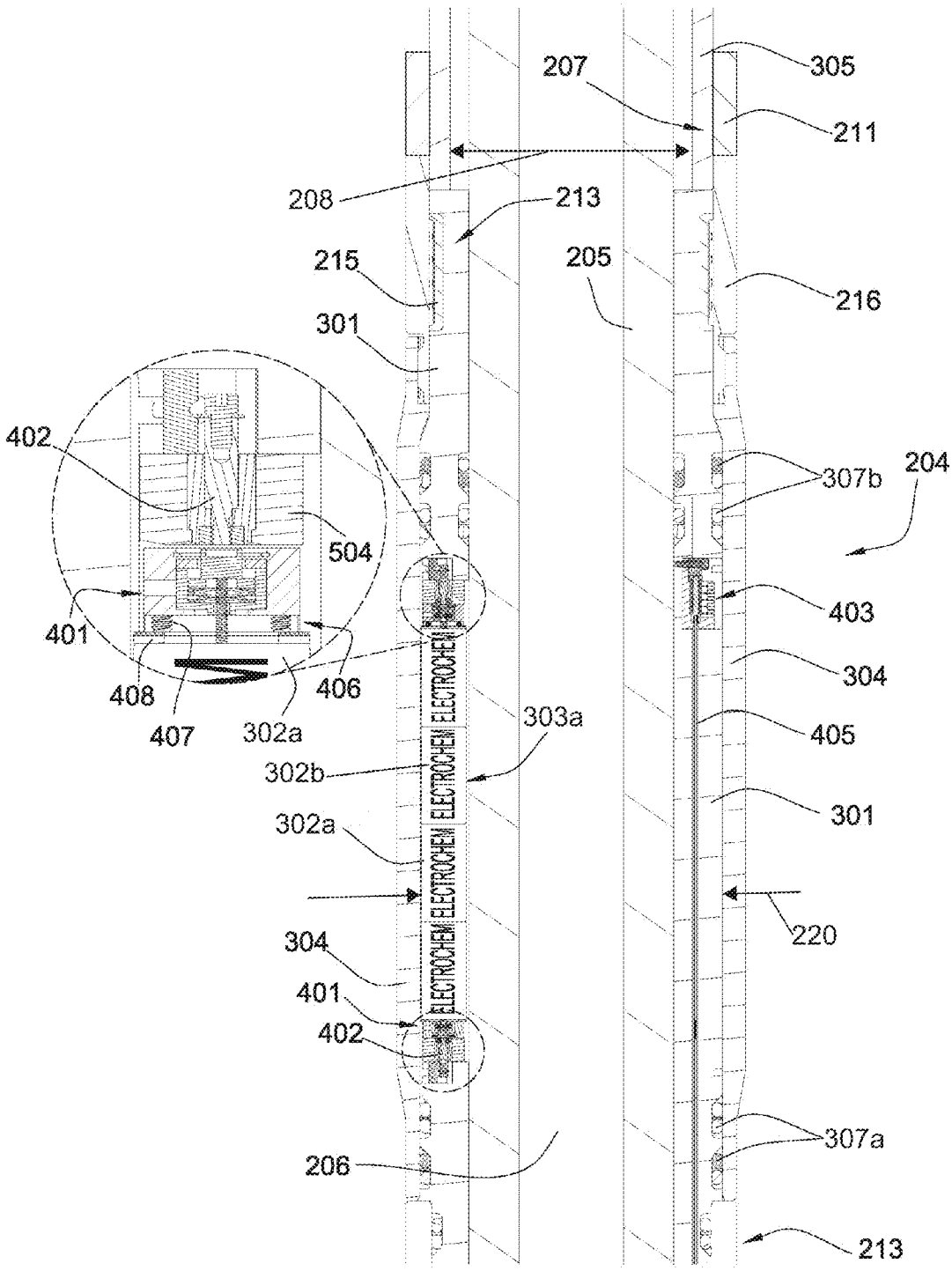
FIG. 4 is a cross-sectional diagram of the independent tubular battery cage illustrated in FIG. 2 disposed around a center mandrel.

Referring now to FIGS. 2 through 4, the downhole drill string 100 (illustrated in FIG. 1) includes a downhole drill string component 201. The a downhole drill string component 201 includes a downhole power assembly 204. The downhole drill string component 201 further includes a center mandrel 205 comprising a through-bore 206 (FIG. 4) adapted to accommodate a flow of drilling fluid. The center mandrel 205 may comprise a first end 203 and a second end 202 adapted to connect the downhole drill string component 201 to a downhole drill string, such as the downhole drill string 100.

Referring to FIGS. 3*a*, 3*b*, and 4, the downhole drill string component 201 comprises an independent tubular battery cage 301 disposed around the center mandrel 205. At least one bay 303*a* is formed in the independent tubular battery cage 301 and at least one battery 302 is disposed in the at least one bay 303*a*. As illustrated in FIGS. 3*a*, 3*b*, and 4, additional batteries, such as battery 302*b*, can be inserted in bay 303*a*. In addition, the tubular battery cage 301 optionally includes additional bays, such as bay 303*b* (FIG. 3*b*) into which additional batteries, such as battery 302*c* can be disposed.

The downhole power assembly 204 also comprises a tubular sleeve 304 (FIGS. 2, 3*c*, and 4) adapted to slide over and cover the tubular battery cage 301. A sleeve slide guide 305 may be formed around the center mandrel 205 adjacent to the tubular battery cage 301, which provides a surface upon which the tubular sleeve 304 may slide. In some embodiments, the sleeve slide guide 305 comprises a similar diameter and length as the tubular battery cage 301. The sleeve slide guide 305 may comprise a first end 207 with an outer diameter 208 (FIG. 4) smaller than an inner diameter 220 (FIG. 4) of the tubular sleeve 304. In addition, the sleeve slide guide 305 may comprise a second end 209 with an outer diameter 210 greater than the inner diameter 220 of the tubular sleeve 304. The first end 207 of the sleeve slide guide 305 may be adapted to abut against an end of the tubular battery cage 301.

It is expected that the tubular sleeve 304 will be adapted to slide off of the tubular battery cage 301 onto the sleeve slide guide 305 allowing access to the at least one battery 302*a* while the downhole drill string component 201 is connected to a downhole drill string. The tubular sleeve 304 may comprise a locking collar 211 (FIGS. 3*c* and 4) adapted to be bolted to the tubular battery cage 301, thereby preventing the tubular sleeve 304 from moving and exposing the tubular battery cage 301.

O-rings 307*a* and 307*b* may be disposed on the tubular battery cage 301 and may provide a water-tight seal between the tubular battery cage 301 and the tubular sleeve 304, thereby protecting the tubular battery cage 301 and the at least one battery 302*a* from fluids disposed in a bore hole, such as bore hole 102 (FIG. 1).

As noted above, U.S. Pat. No. 6,442,105 Tubel discloses an acoustic tool comprising a mandrel with a sleeve adapted to cover cavities machined into the mandrel to accommodate components of the acoustic tool including a battery pack assembly. It is believed that machining cavities into a mandrel negatively impacts the structural integrity of the mandrel. It is believed that the present invention provides a mode by which batteries, such as battery 302*a* may be stored on a mandrel, such as mandrel 205, without negatively impacting the structural integrity of the mandrel.

The downhole power assembly 204 may be in communication with and provide electrical power to an electronics assembly 213*a* and 213*b*. The electronics assembly 213 may be disposed around the center mandrel 205 and adjacent to the tubular battery cage 301. The electronics assembly 213 may comprise geophones 214*a*, 214*c*, and 214*b*, hydrophones 215, and combinations thereof. The electronics assembly 213*a* and 213*b* may also comprise accelerometers, inclinometers, pressure transducers, magnetometers, gyroscopes, temperature sensors, gamma ray sensors, neutron sensors, seismic sensors, sonic sensors, mud logging devices, resistivity sensors, induction sensors, nuclear sensors, imaging devices, GPS devices, Hall-effect sensors, permeability sensors, porosity sensors, vibration sensors, electrical potential sensors, a downhole hammer, a mud pulser, a CPU, and combinations thereof. The tubular sleeve 304 may comprise a hydrophone cover 216 adapted to protect the hydrophones 215.

Left threaded nuts 217 may be placed on the center mandrel 205 to restrain the movement of the electronics assembly 213*a* and 213*b*, the tubular battery cage 301, and the sleeve slide guide 305 along a length of the center mandrel 205.

The at least one bay 303*a* may be adapted to accommodate a battery pack 306 comprising at least two batteries 302*a* and 302*b*. The battery pack 306 may comprise two end caps 504 and to two length straps 505 connected together to enclose the at least two batteries 302*a* and 302*b*. At least one electrical connector 401 (inset, FIG. 4) may be incorporated into the end caps 504 of the battery pack 306 and is adapted to provide an electrical connection between the batteries 302*a* and 302*b* and an electrical lead 402 disposed in the at least one bay 303*a*.

The battery pack 306 may comprise an adjustable packing bumper 406 adapted to pack the batteries 302*a* and 302*b* in the battery pack 306 tightly against each other. The adjustable packing bumper 406 may comprise a bumper pad 408 and supporting lugs 407. As the battery pack 306 is assembled, the adjustable packing bumper 406 may be adjusted so as to fit different sized batteries 302*a* and 302*b* into the battery pack 306.

Figure 5A:
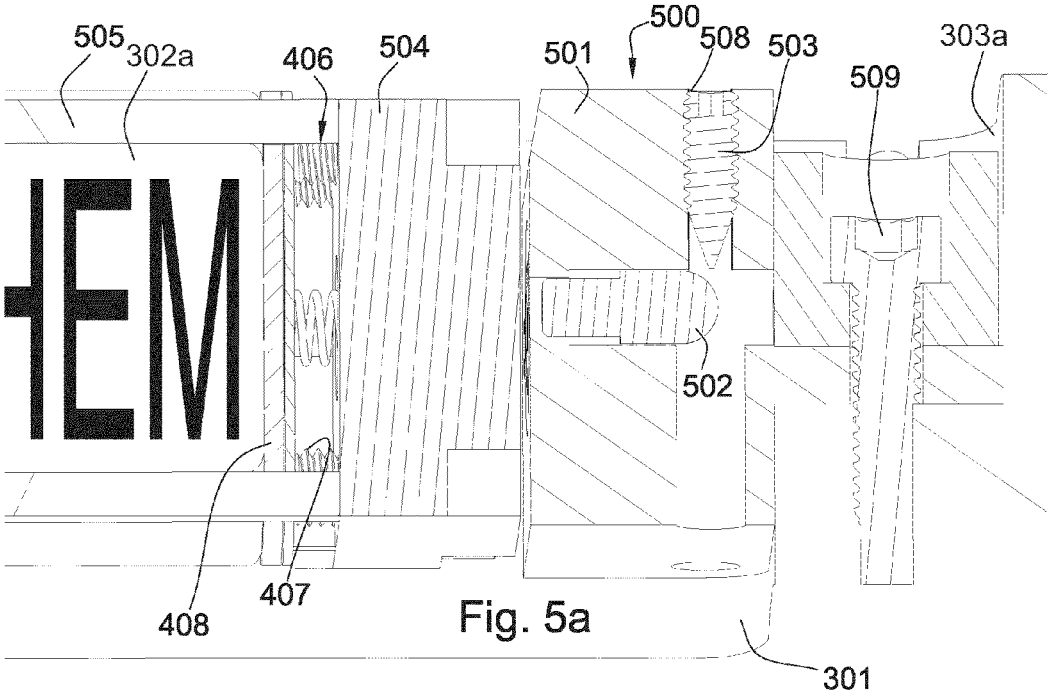
FIG. 5*a* is a close-up of the magnified view of the cross-sectional diagram of the mechanical retainer illustrated in FIG. 4.
Figure 5B:
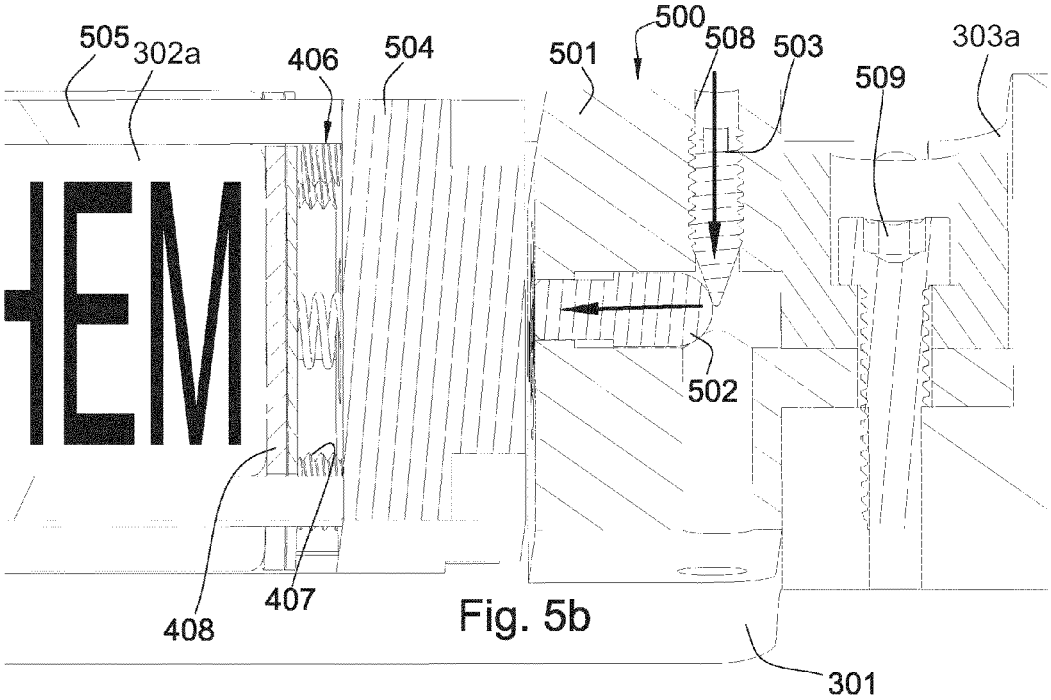
FIG. 5*b* is another close-up of the magnified view of the cross-sectional diagram of the mechanical retainer illustrated in FIG. 5*a*.

Referring now to FIGS. 5*a* and 5*b*, at least one mechanical retainer 500 may be disposed in the at least one bay 303*a* and may be adapted to mechanically retain the at least one battery 302*a* in the at least one bay 303*a*. The at least one mechanical retainer 500 may also be adapted to retain the battery pack 306 (FIGS. 3*a* and 3*b*) in the at least one bay 303*a*. A bolt 509 may be used to mount the at least one mechanical retainer 500 to the tubular battery cage 301 in the at least one bay 303*a*.

The mechanical retainer 500 may comprise an extending pin 502 adapted to extend from a body 501 of the mechanical retainer 500 into the at least one bay 303*a*. The extending pin 502 may be spring actuated, actuated by a biased driving element, piston actuated, and combinations thereof. In FIGS. 5*a* and 5*b*, the extending pin 502 is actuated by a biased driving element 503 disposed in a recess 508 formed in the body 501 of the mechanical retainer 500. The biased driving element 503 may be driven into the recess 508 and against the extending pin 502 by a hex key 308 (FIG. 3*b*) or a screw driver. As the biased driving element 503 is driven against the extending pin 502, the extending pin 502 extends from the body 501 of the mechanical retainer 500 into the at least one bay 303*a* and applies pressure against the at least one battery 302*a* or one of the end caps 504 of the battery pack 306 (FIGS. 3*a* and 3*b*). It is believed that the pressure applied against the at least one battery 302*a* or the battery pack 306 by the extending pin 502 will mechanically retain the at least one battery 302*a* or the battery pack 306 within the at least one bay 303*a*.

Figure 6:
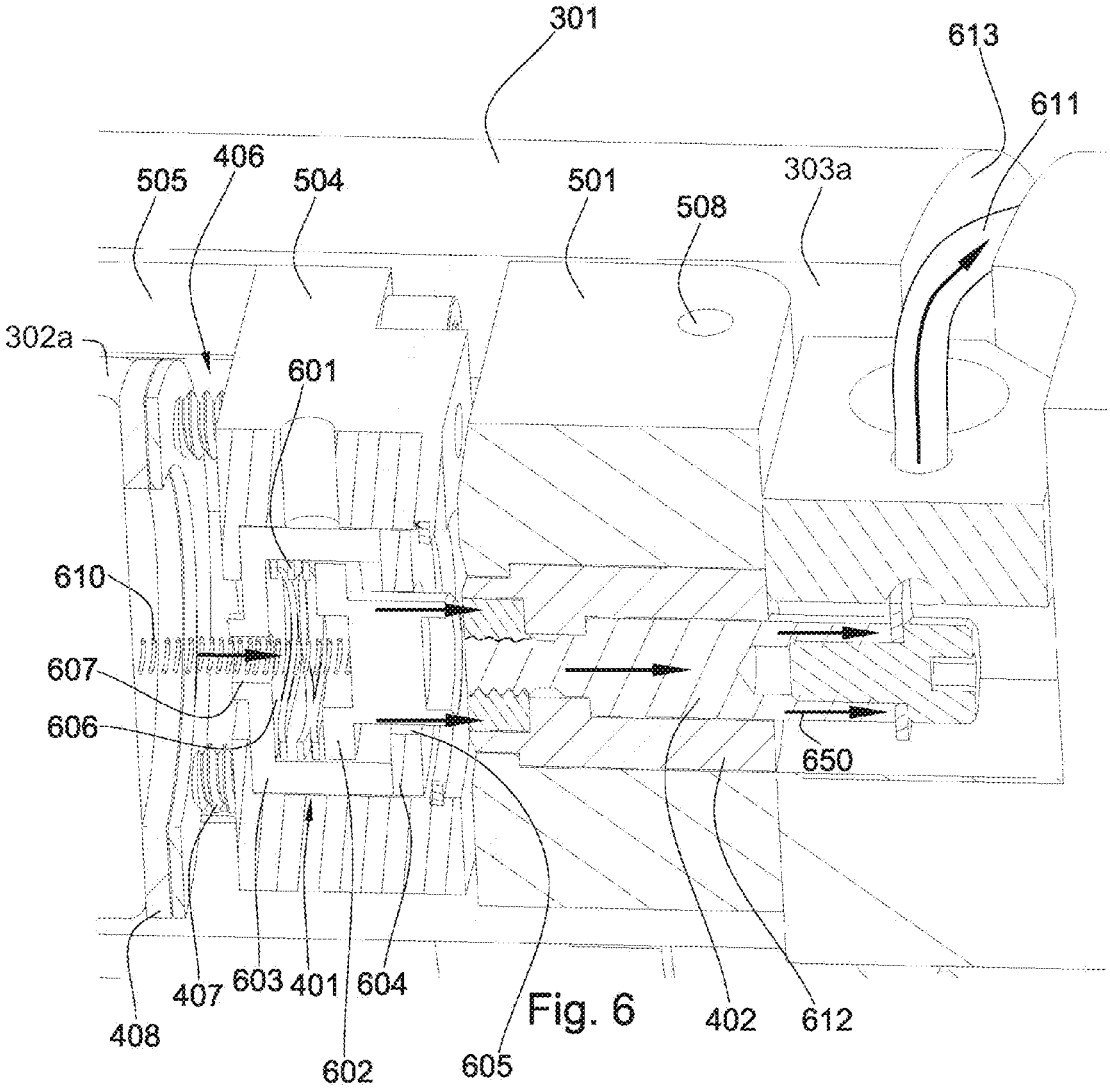
FIG. 6 is a cross-sectional diagram of an embodiment of an electrical connector.

FIG. 6 discloses the embodiment of the at least one electrical connector 401 incorporated into an end cap 504 of the battery pack 306, discussed above vis-à-vis FIG. 4. The at least one electrical connector 401 may comprise an expandable element 601 disposed in a box 603 adapted to extend a plunger contact 602 through a hole 605 formed in a lid 604 of the box 603. The expandable element 601 may be a spring, a wave spring, a coil spring, compressible foam, rubber, gas, or combinations thereof. The embodiment of the expandable element 601 disclosed in FIG. 6 is a wave spring. As the plunger contact 602 extends through the hole 605 formed in the lid of the box 603, the plunger contact 602 is expected to contact the electrical lead 402 of the at least one bay 303*a*.

In addition, the at least one electrical connector 401 may comprise a coil spring 610 adapted to extend through a hole 607 formed in a bottom 606 of the box 603 and contact the plunger contact 602 and a terminal of the battery 302*a*.

It is believed that the at least one electrical connector 401 may be adapted to provide an electrical connection between the at least one battery 302*a* and the electronics assembly 213*a* and 213*b* independent of the mechanical retention of the at least one battery 302*a* in the at least one bay 303*a*. It is believed that electrical current 650 will travel from the battery 302*a* through the coil spring 610 into the plunger contact 602 and from the plunger contact 602 into the electrical lead 402 of the at least one bay 303*a*.

The electrical lead 402 may extend through the body 501 of the mechanical retainer 500 to a junction wire 611 adapted to carry the electrical current 650 outside of the at least one bay 303*a*. A channel 613 may be formed in the tubular battery cage 301 to accommodate the junction wire 611.

Further, an insulation element 612 may be disposed around the electrical lead 402 and may be adapted to electrically isolate the electrical lead 402 from the body 501 of the mechanical retainer 500.

Figure 7:
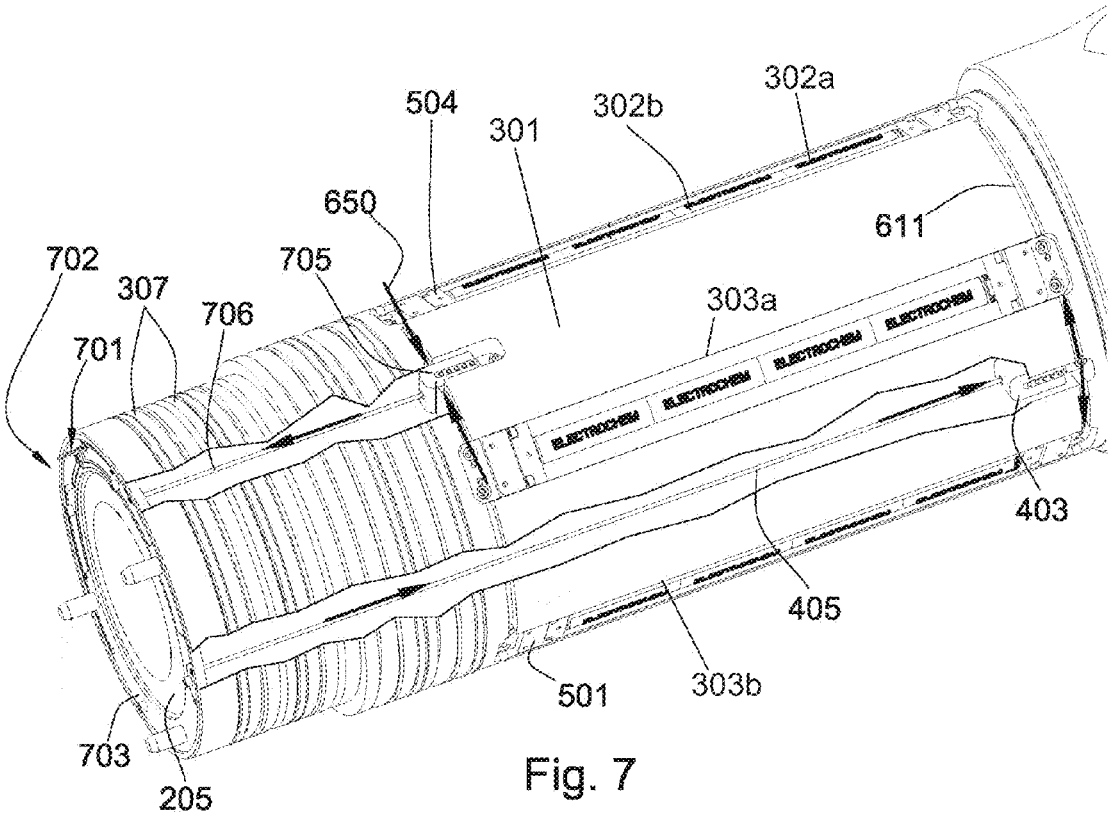
FIG. 7 is a perspective diagram of an embodiment of an independent tubular battery cage disposed around a center mandrel.
Figure 8:
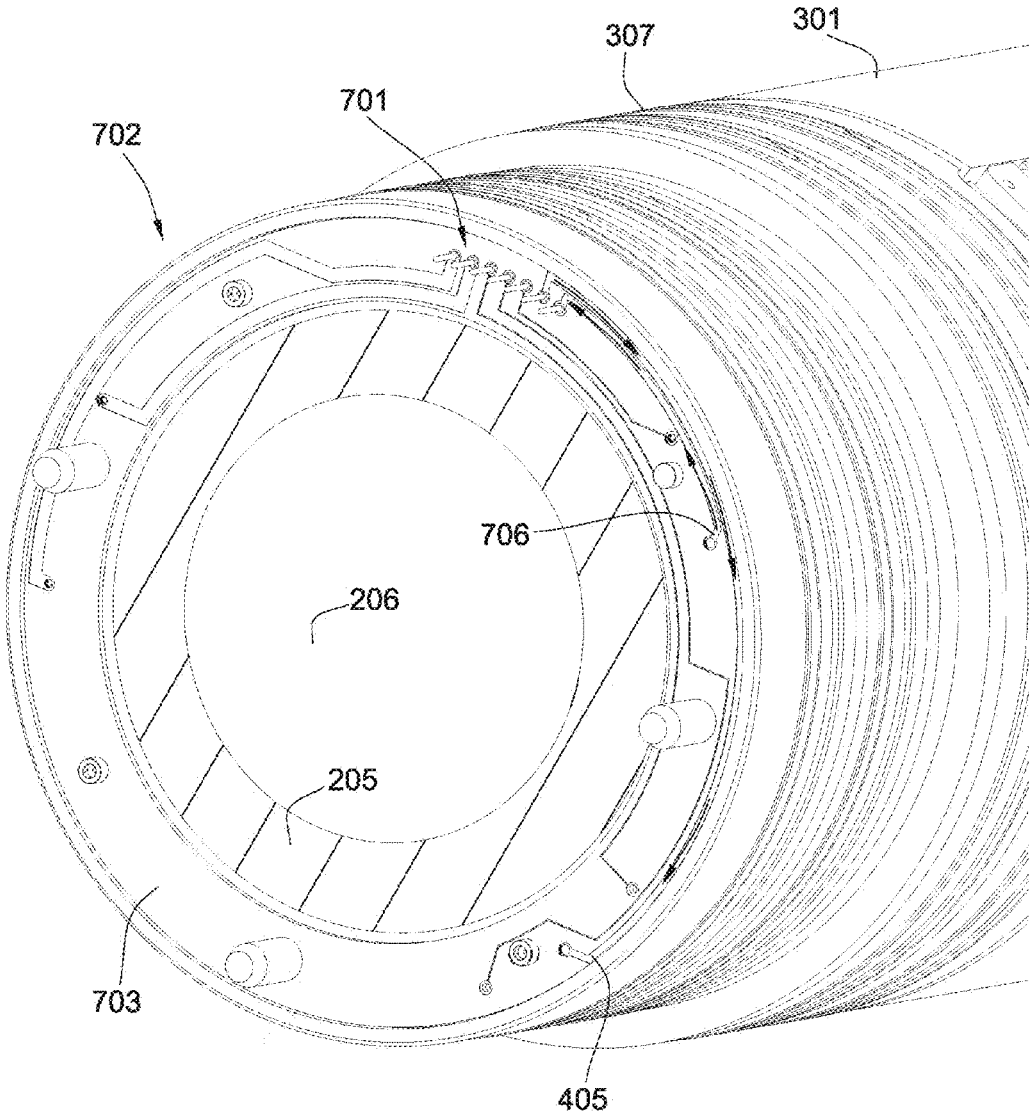
FIG. 8 is a perspective diagram of an embodiment of a first end of the tubular battery cage.

Referring now to FIG. 7, the junction wire 611 electrically connects the at least one bay 303*a* to a positive junction 403 and a negative junction 705. The tubular battery cage 301 may comprise five bays, such as bays 303*a* and 303*b*, connected electrically in parallel to the positive junction 403 and the negative junction 705.

The positive junction 403 and the negative junction 705 may connect to an electrical contact 701 through wires 706, 405, respectively. The electrical contact 701 may be in electrical communication with electronics, such as electronics 213*a* and 213*b*elsewhere in the downhole component. The electrical contact 701 may be disposed at a first end 702 of the tubular battery cage 301. The electrical contact 701 may be mounted on a circular circuit board 703 disposed at a first end 702 of the tubular battery cage 301.

Figure 9:
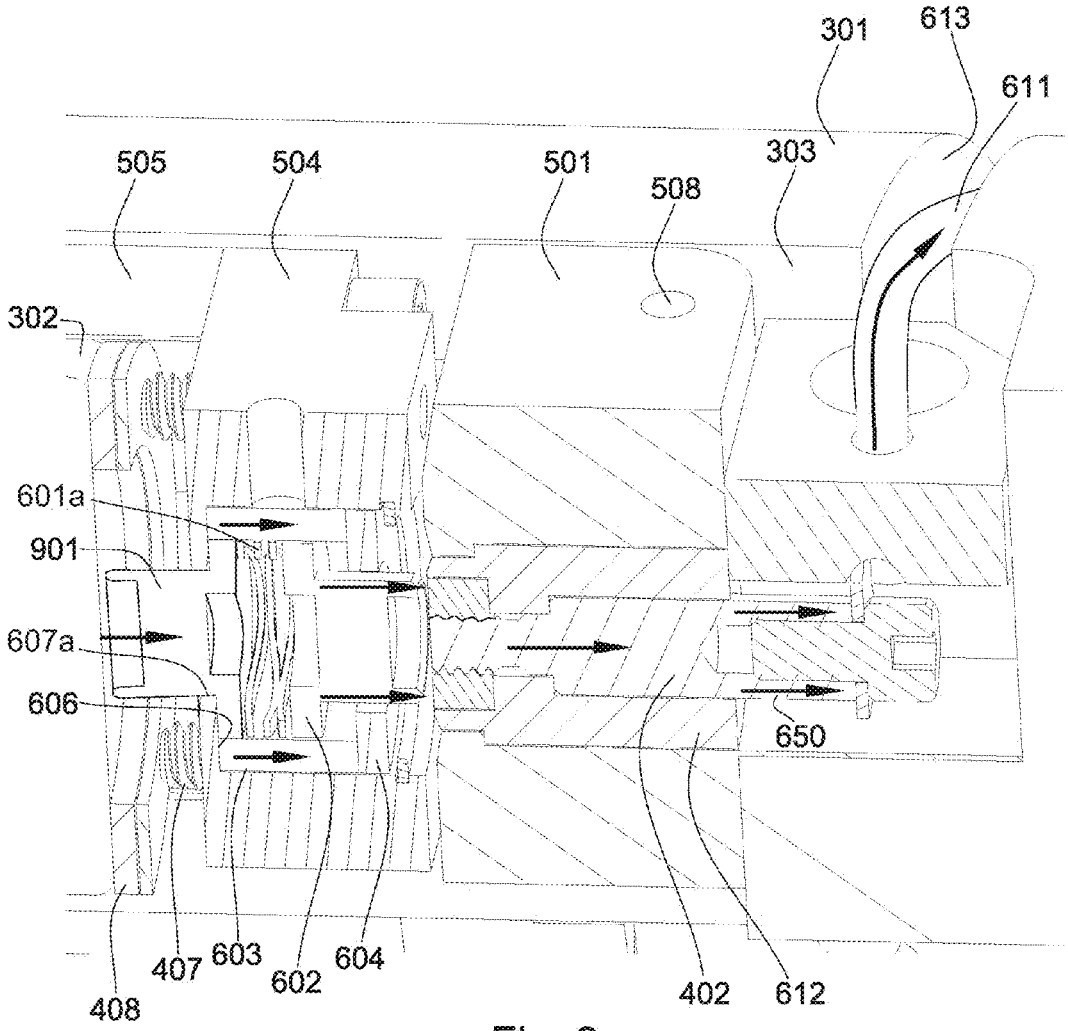
FIG. 9 is a cross-sectional diagram of another embodiment of an electrical connector.

FIG. 9 discloses an embodiment wherein an electrical connector 401*a* may comprise a second plunger contact 901. The expandable element 601*a* may be adapted to extend the second plunger contact 901 through a hole 607*a* formed in a bottom 606*a* of a box 603*a*.

Figure 10:
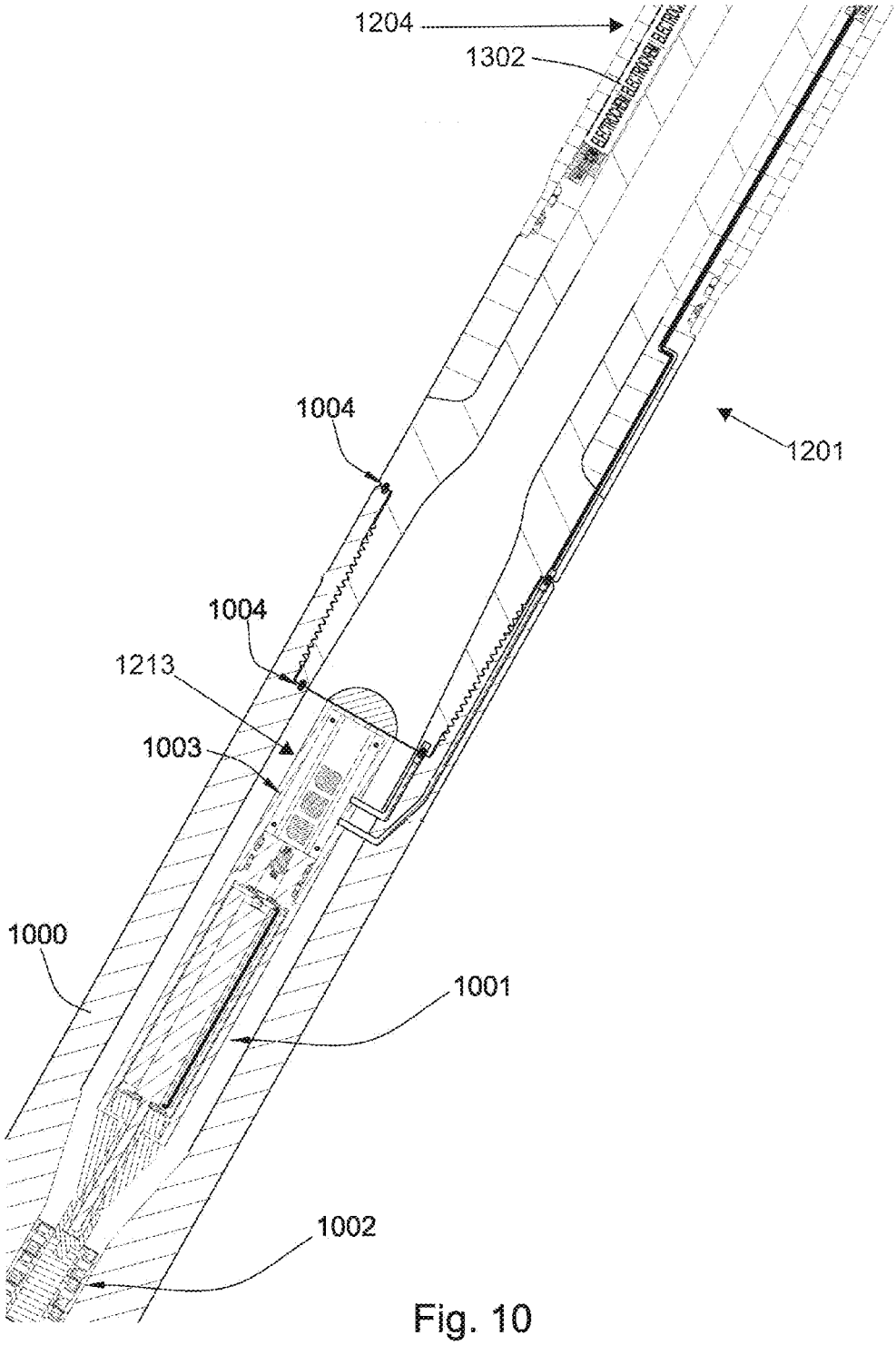
FIG. 10 is a cross-sectional diagram of an embodiment of a downhole generator in communication with a downhole drill string component that includes an embodiment of a downhole power assembly.

Referring now to FIG. 10, an electrical generator 1001 may be disposed in another downhole drill string component 1000 and may be adapted to send electrical power across at least one inductive coupler 1004 to a downhole drill string component 1201 that includes a downhole power assembly 1204 and at least one battery 1302, thereby recharging the at least one battery 1302. Alternatively, the downhole power assembly 1204 may be adapted to send power across the at least one inductive coupler 1004 to the another downhole drill string component 1000. An embodiment of an inductive coupler 1004 that may be compatible with the present invention is disclosed in U.S. patent application Ser. No. 11/860,795 to Hall, which is herein incorporated by reference for all it contains.

An electronics assembly 1213 may also be disposed on the another downhole drill string component 1000. In the embodiment disclosed in FIG. 10, the electronics assembly 1213 comprises a CPU 1003 adapted to regulate a flow of electrical power across the inductive coupler 1004.

The electrical generator 1001 may be powered by a downhole turbine 1002 actuated by a flow of drilling fluid through a downhole drill string, such as downhole drill string 100 illustrated in FIG. 1.

Whereas the present invention has been described in particular relation to the drawings attached hereto, it should be understood that other and further modifications apart from those shown or suggested herein, may be made within the scope and spirit of the present invention.

What is claimed is:

1. A downhole drill string component, comprising:

a center mandrel with a through-bore adapted to accommodate a flow of drilling fluid;

a power assembly that includes:

a battery cage disposed around and apart from the center mandrel, the battery cage including at least one bay formed therein; and, at least one battery disposed in the at least one bay;

a sleeve configured to slidably cover said battery cage, said sleeve having an inner diameter; and, a sleeve slide guide disposed around said center mandrel and adjacent to said battery cage, said sleeve slide guide having a first end having an outer diameter smaller than said inner diameter of said sleeve and a second end having an outer diameter greater than said inner diameter of said sleeve.

2. The drill string component of claim 1, wherein the first end of the sleeve slide guide is adapted to abut against an end of the battery cage.

3. The drill string component of claim 1, wherein the sleeve is adapted to slide off of the battery cage onto the sleeve slide guide.

4. The drill string component of claim 1, further comprising a locking collar adapted to prevent the sleeve from moving when the sleeve is positioned over the battery cage.

5. The drill string component of claim 1, wherein the power assembly is in electrical communication with and provides electrical power to an electronics assembly.

6. The drill string component of claim 5, wherein the electronics assembly is disposed on another downhole drill string component.

7. The drill string component of claim 6, wherein the power assembly provides electrical power across at least one inductive coupler to the electronics assembly on the another downhole drill string component.

8. The drill string component of claim 1, wherein at least one mechanical retainer is disposed in the at least one bay and is adapted to mechanically retain the at least one battery in the at least one bay.

9. The drill string component of claim 8, wherein the mechanical retainer comprises an extending pin disposed within a body of the mechanical retainer, the extending pin adapted to extend into and retract from the at least one bay.

10. The drill string component of claim 8, wherein the power assembly is in electrical communication with and provides electrical power to an electronics assembly through at least one electrical connector that is electrically isolated from the at least one mechanical retainer.

11. The drill string component of claim 10, wherein the at least one electrical connector includes an expandable element disposed in a box adapted to extend a plunger contact through a hole formed in a lid of the box.

12. The drill string component of claim 11, wherein the expandable element is adapted to extend a second plunger contact through a hole formed in a bottom of the box.

13. The drill string component of claim 1, wherein the at least one battery is in electrical communication with and receives electrical power across at least one inductive coupler from an electrical generator powered by a downhole turbine disposed in another downhole tool string component.

14. The drill string component of claim 1, wherein said sleeve is configured to slide off of said battery cage and onto said sleeve slide guide.

15. A downhole drill string component, comprising:

a center mandrel with a through-bore adapted to accommodate a flow of drilling fluid;

a power assembly that includes:

a battery cage disposed around and apart from said center mandrel, said battery cage including at least one bay formed therein;

at least one battery disposed in said at least one bay; and, one mechanical retainer disposed in said at least one bay, said mechanical retainer including an extending pin disposed within a body of the mechanical retainer and a biased driving element, said biased driving element being configured to urge said extending pin to extend into said at least one bay; and, a sleeve configured to slidably cover said battery cage, a sleeve slide guide disposed around said center mandrel and adjacent to said battery cage guide, said sleeve slide guide having a first end having an outer diameter smaller than an inner diameter of said sleeve and a second end having an outer diameter greater than said inner diameter of said sleeve.

16. The drill string component of claim 15, wherein said sleeve is configured to slide off of said battery cage and onto said sleeve slide guide.

* * * * *